US006593847B2

(12) United States Patent
Miyazaki et al.

(10) Patent No.: US 6,593,847 B2
(45) Date of Patent: Jul. 15, 2003

(54) PLANAR ACOUSTIC CONVERTING APPARATUS

(75) Inventors: Toshiiku Miyazaki, Tokyo (JP); Masashi Hori, Tokyo (JP); Takeshi Nishimura, Tokyo (JP); Kenji Iizuka, Tokyo (JP); Masayuki Ishiwa, Tokyo (JP)

(73) Assignees: The Furukawa Electric Co., Ltd., Tokyo (JP); FPS, Inc., Tokyo (JP)

( * ) Notice: Subject to any disclaimer, the term of this patent is extended or adjusted under 35 U.S.C. 154(b) by 243 days.

(21) Appl. No.: 09/853,293

(22) Filed: May 10, 2001

(65) Prior Publication Data

US 2001/0048256 A1 Dec. 6, 2001

(30) Foreign Application Priority Data

May 22, 2000 (JP) ..... 2000-150058

(51) Int. Cl.[7] ..... G10K 9/00; H01F 27/28

(52) U.S. Cl. ..... 340/388.1; 340/388.3; 340/396.1; 336/232

(58) Field of Search ..... 340/388.1, 388.3, 340/396.1, 7.6; 336/225, 232

(56) References Cited

U.S. PATENT DOCUMENTS

| | | | | | |
|---|---|---|---|---|---|
| 4,340,833 | A | * | 7/1982 | Sudo et al. | 310/268 |
| 4,959,631 | A | * | 9/1990 | Hasegawa et al. | 336/200 |
| 5,503,020 | A | * | 4/1996 | Mandracchia | 73/643 |
| 5,811,682 | A | * | 9/1998 | Ohtani et al. | 73/643 |

FOREIGN PATENT DOCUMENTS

| | | |
|---|---|---|
| JP | 4-39279 | 6/1992 |
| JP | 6-339194 | 12/1994 |
| WO | WO99/03304 | 1/1999 |

* cited by examiner

*Primary Examiner*—Donnie L. Crosland
(74) *Attorney, Agent, or Firm*—Knobbe Martens Olson & Bear LLP

(57) ABSTRACT

This invention provides a planar acoustic converting apparatus including a support having a flat plate portion, a diaphragm which has an insulating base film having a liquid crystalline polymer film and being opposed to the flat plate portion of the support and at least one spiral coil provided on one major surface or both major surfaces of the insulating base film, at least one permanent magnet supported by the support and opposing a magnetic pole to the diaphragm, and a holding portion provided to the support and holding the diaphragm such that the diaphragm can vibrate and is positioned apart from the at least one permanent magnet.

19 Claims, 7 Drawing Sheets

PLANAR ACOUSTIC CONVERTING APPARATUS

CROSS-REFERENCE TO RELATED APPLICATIONS

This application is based upon and claims the benefit of priority from the prior Japanese Patent Application No. 2000–150058, filed May 22, 2000, the entire contents of which are incorporated herein by reference.

BACKGROUND OF THE INVENTION

The present invention relates to a planar acoustic converting apparatus.

FIG. 1 is a sectional view schematically showing a conventional planar acoustic converting apparatus. The planar acoustic converting apparatus shown in FIG. 1 is disclosed in WO/099/03304 and has a flat yoke 10 formed from a ferromagnetic metal plate such as an iron plate, and permanent magnets 12 attached to one surface of the yoke 10 with their magnetic axes set perpendicular to the surface of the yoke 10. The permanent magnets 12 are arrayed on one major surface of the yoke 10 while being spaced apart from each other by a predetermined gap, and attached to the yoke 10 such that adjacent permanent magnets have opposite polarities.

The planar acoustic converting apparatus shown in FIG. 1 also has a diaphragm 14. This diaphragm 14 is held while being apart from the pole-faces of the permanent magnets 12 by a predetermined distance. The diaphragm 14 has a structure in which spiral coils 18 are formed on both surfaces (or one surface) of an insulating base film 16 in correspondence with the permanent magnets 12. The spiral coils 18 are formed such that each coil 18 surrounds a region being opposed to the magnetic pole of a corresponding permanent magnet 12 and such that, near the boundary between each two coils 18 adjacent to each other, a direction of current-flow through the conductor of one coil 18 is the same as that of another coil 18.

FIG. 2 is a view schematically showing the wiring pattern of the spiral coils 18 shown in FIG. 1. Referring to FIG. 2, reference numeral $\mathbf{18}n_1$ denotes a coil formed on the upper surface of the base film 16, and reference numeral $\mathbf{18}n_2$ denotes a coil formed on the lower surface of the base film in correspondence with the coil $\mathbf{18}n_1$. The coil $\mathbf{18}n_1$ on the upper surface spirals clockwise from the outer to the inner side. On the other hand, the coil $\mathbf{18}n_2$ on the lower surface spirals clockwise from the inner to the outer side. The internal end of the coil $\mathbf{18}n_1$ and that of the coil $\mathbf{18}n_2$ corresponding to the coil $\mathbf{18}n_1$ are electrically connected to each other via a through hole or through stud extending through the base film 16. Hence, the coils $\mathbf{18}n_1$ and $\mathbf{18}n_2$ constitute one coil 18 which spirals clockwise.

Referring to FIG. 2, reference numeral $\mathbf{18}m_1$ denotes a coil formed on the upper surface of the base film 16 to be adjacent to the coil $\mathbf{18}n_1$, and reference numeral $\mathbf{18}m_2$ denotes a coil formed on the lower surface of the base film 16 to be adjacent to the coil $\mathbf{18}n_2$. The coil $\mathbf{18}m_2$ on the lower surface has an outer end connected to that of the adjacent coil $\mathbf{18}n_2$ and spirals counterclockwise from the outer to the inner side. On the other hand, the coil $\mathbf{18}m_1$ on the upper surface spirals counterclockwise from the inner to the outer side. The internal end of the coil $\mathbf{18}m_1$ and that of the coil $\mathbf{18}m_2$ corresponding to the coil $\mathbf{18}m_1$ are electrically connected to each other via a through hole or through stud extending through the base film 16. Hence, the coils $\mathbf{18}m_1$ and $\mathbf{18}m_2$ constitute one coil 18 which spirals counterclockwise.

When the plurality of spiral coils 18 are formed in this way, near the boundary between adjacent coils 18, a current flows through the wire of one coil 18 in the same direction as that of the current flowing through the wire of the other coil 18. Each coil 18 is placed in a magnetic field formed by a corresponding permanent magnet 12 that has a polarity opposite to that of an adjacent permanent magnet 12, as shown in FIG. 1. For this reason, when a current flows in the above way, the diaphragm 14 receives an electromagnetic force by the Fleming's left-hand rule. That is, as shown in FIG. 2, when magnetic poles N and S of the permanent magnets 12 form magnetic fields H, and currents flow through the coils 18 in the directions of arrows, a force is generated in a direction F. With this principle, the diaphragm 14 vibrates in correspondence with the sound currents flowing through the coils 18.

A planar acoustic converting apparatus of such type can be made as thin as about 5 to 15 mm and can be suitably used for a wall-type TV or notebook personal computer. Such a planar acoustic converting apparatus can also be built in a pillar or sun visor of a car.

However, in a planar acoustic converting apparatus of this type, each coil generates Joule heat. In addition, since the area occupied by the spiral coils 18 on the base film 16 is very large, the influence of heat on the base film 16 cannot be neglected. To prevent this, it has been proposed to use a polyimide film with high heat resistance as the base film 16. However, tan $\delta$, which is an index of acoustic absorptivity, of a polyimide film is as low as 0.02, so noise, so-called chattering noise, is readily generated when the diaphragm 14 vibrates. In addition, since a polyimide film is hygroscopic, when a polyimide film is used as the base film 16, the sound quality is expected to change due to a slight extension upon absorbing moisture.

Use of a PET (polyethylene terephthalate) film as the base film 16 has also been proposed. However, a PET film has also poor acoustic absorptivity tan $\delta$=0.014, and noise is readily generated when the diaphragm 14 vibrates.

In a planar acoustic converting apparatus of the above type, when the diaphragm 14 largely vibrates, it may hit the permanent magnet 12 to generate impact noise. This problem becomes more conspicuous when the diaphragm 14 slacks due to the above-described heat generation by the coils 18. As a known means for preventing this problem, a flexible material such as polyurethane foam or glass wool is inserted between the diaphragm 14 and the permanent magnets 12. However, such a flexible material hinders the free vibration of the diaphragm 14 to degrade the sound quality.

When the coils 18 receive an electromagnetic force, the diaphragm 14 vigorously vibrates in the direction of thickness. If the adhesive force between the base film 16 and the coils $\mathbf{18}m_1$, $\mathbf{18}m_2$, $\mathbf{18}n_1$, and $\mathbf{18}n_2$ is not sufficiently strong, the coils $\mathbf{18}m_1$, $\mathbf{18}m_2$, $\mathbf{18}n_1$, and $\mathbf{18}n_2$ may peel off from the base film 16. The diaphragm 14 having the plurality of spiral coils 18 formed on one or both surfaces of the base film 16 can be manufactured by the normal flexible printed circuit board manufacturing technology. To effectively prevent the coils $\mathbf{18}m_1$, $\mathbf{18}m_2$, $\mathbf{18}n_1$, and $\mathbf{18}n_2$ from peeling off in such a manufacturing technology, the surfaces of the base film 16 are roughened to increase the adhesive force per unit area, or the conductor width of the coils $\mathbf{18}m_1$, $\mathbf{18}m_2$, $\mathbf{18}n_1$, and $\mathbf{18}n_2$ is increased. However, the former technique can hardly be applied when a thin base film 16 is used to improve the vibration characteristic, and the latter technique is not preferable because the planar acoustic converting apparatus becomes bulky.

BRIEF SUMMARY OF THE INVENTION

It is an object of the present invention to provide a planar acoustic converting apparatus in which generation of noise is suppressed.

It is another object of the present invention to provide a planar acoustic converting apparatus in which impact noise generated by collision of the diaphragm to the permanent magnets can be suppressed without hindering free vibration of the diaphragm.

It is still another object of the present invention to provide a reliable planar acoustic converting apparatus in which the spiral coils of the diaphragm hardly peel off from the base film.

According to the first aspect of the present invention, there is provided a planar acoustic converting apparatus comprising a support having a flat plate portion, a diaphragm comprising an insulating base film having a liquid crystalline polymer film and being opposed to the flat plate portion of the support, and at least one spiral coil provided on one major surface or both major surfaces of the insulating base film, at least one permanent magnet supported by the support and opposing a magnetic pole thereof to the diaphragm, and a holding portion provided to the support and holding the diaphragm such that the diaphragm can vibrate and is positioned apart from the at least one permanent magnet.

According to the second aspect of the present invention, there is provided a planar acoustic converting apparatus comprising a support having a flat plate portion, a diaphragm comprising an insulating base film and being opposed to the flat plate portion of the support, and at least one spiral coil provided on one major surface or both major surfaces of the insulating base film, at least one permanent magnet supported by the support and opposing a magnetic pole thereof to the diaphragm, a damper sheet provided on a surface of the at least one permanent magnet being opposed to the insulating base film, and a holding portion provided to the support and holding the diaphragm such that the diaphragm can vibrate and is positioned apart from the at least one permanent magnet.

According to the third aspect of the present invention, there is provided a planar acoustic converting apparatus comprising a support having a flat plate portion, a diaphragm comprising an insulating base film having a liquid crystalline polymer film and being opposed to the flat plate portion of the support, at least one spiral coil provided on one major surface or both major surfaces of the insulating base film, and an insulation film which covers the at least one spiral coil and the insulating base film, at least one permanent magnet supported by the support and opposing a magnetic pole thereof to the diaphragm, and a holding portion provided to the support and holding the diaphragm such that the diaphragm can vibrate and is positioned apart from the at least one permanent magnet.

The term "liquid crystalline polymer" is used with the same meaning and scope as in normal use. That is, the term "liquid crystalline polymer" used here includes a polymer that exhibits fluidity and characteristics of a crystal in molten state. Hence, the term "liquid crystalline polymer film" includes a film constituted by such a "liquid crystalline polymer".

The term "tan δ" represents the degree of conversion of a mechanical energy applied to a film into a thermal energy, i.e., the degree of internal loss, and is used as an index related to the acoustic absorptivity of the film. Letting E' be the storage elastic modulus, and E" be the loss elastic modulus, "tan δ" can be calculated by using the following equation.

$$\tan \delta = E''/E'$$

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Figure 1:
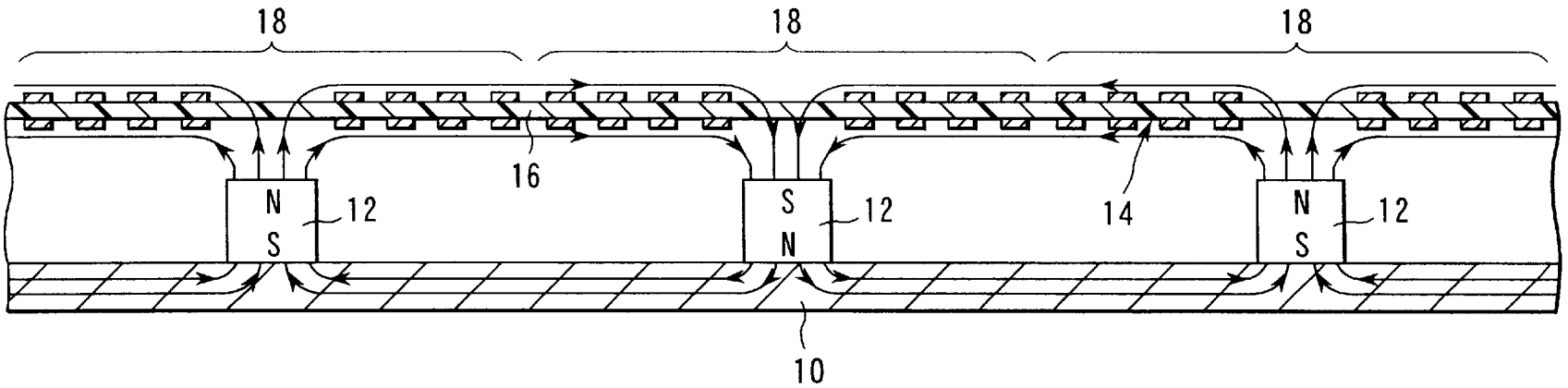
FIG. 1 PRIOR ART
FIG. 1 is a sectional view schematically showing a conventional planar acoustic converting apparatus.

The present invention will be described below in more detail. The first to third aspects of the present invention will be described first.

As described above, in the planar acoustic converting apparatus according to the first aspect of the present invention, the insulating base film has a liquid crystalline polymer film. A liquid crystalline polymer film has high heat resistance and mechanical strength and a small linear expansion coefficient. For this reason, in the planar acoustic converting apparatus according to the first aspect, even when the temperature of the base film increases due to heat from the coils, the dimensions of the diaphragm do not largely change. In addition, the hygroscopicity of a liquid crystalline polymer film is much lower than that of a normal resin film. For this reason, in the planar acoustic converting apparatus according to this aspect, the base film hardly expands even under a high humidity. That is, in the planar acoustic converting apparatus according to the first aspect, even in use for a long time or even under a high humidity, the diaphragm hardly slacks, and therefore, the sound quality hardly degrades. Generally, a liquid crystalline polymer film tends to have high tang. For this reason, in the planar acoustic converting apparatus according to the first aspect, mechanical energy corresponding to noise is consumed by being converted to thermal energy so that generation of noise such as chattering noise can be suppressed. Furthermore, as described above, the linear expansion coefficient of a liquid crystalline polymer film is small. For this reason, in the planar acoustic converting apparatus according to the first aspect, since the linear expansion coefficient difference between the base film and the conductor such as copper that forms the coils is small, the coils can be suppressed from peeling off from the base film. That is, high reliability can be realized.

In the planar acoustic converting apparatus according to the second aspect of the present invention, a damper sheet is provided on those surfaces of the permanent magnets, which are opposed to the insulating base film, and the holding portion holds the diaphragm such that the diaphragm is positioned apart from the damper sheet and the diaphragm can freely vibrate. In this arrangement, since a gap is formed between the diaphragm and the damper sheet, the vibration of the diaphragm is not hindered. In addition, since the damper sheet is provided on the permanent magnets, generation of noise such as impact noise can be suppressed even when the diaphragm largely vibrates and comes into contact with the permanent magnets. For this reason, according to the second aspect of the present invention, the sound quality can be improved, and noise can be suppressed.

In the planar acoustic converting apparatus according to the third aspect, the diaphragm has an insulation film that covers the spiral coils and insulating base film. The insulation film presses the spiral coils to the base film to prevent the spiral coils from peeling off from the base film due to vibration. The insulation film also protects the spiral coils from rusting. Hence, according to the third aspect of the present invention, the spiral coils on the diaphragm are prevented from peeling off from the base film, and therefore, a reliable planar acoustic converting apparatus is realized. Additionally, when the base film and insulation film are made of different materials, generation of noise such as chattering noise can be suppressed and the SPL vs. frequency characteristic can be flattened by the damping function of the insulation film.

The first and second embodiments of the present invention will be described next in detail with reference to the accompanying drawing. The same reference numerals denote the same parts throughout the drawing, and redundant descriptions will be omitted.

The first embodiment of the present invention will be described first with reference to FIGS. 3 to 5.

Figure 3:
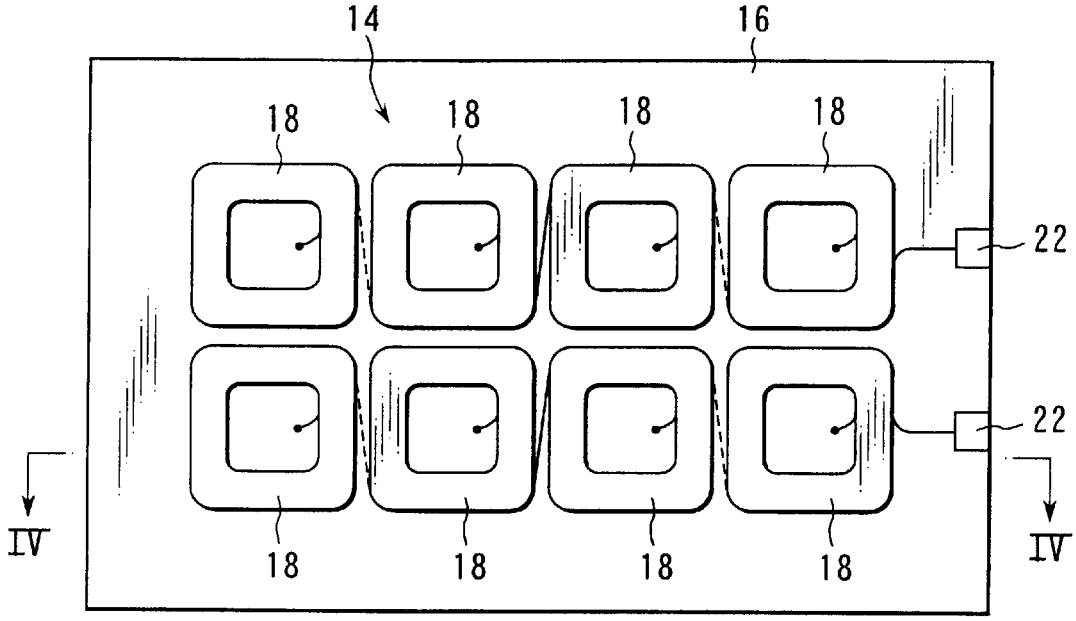
FIG. 3 is a plan view schematically showing a planar acoustic converting apparatus according to the first embodiment of the present invention.

FIG. 3 is a plan view schematically showing a planar acoustic converting apparatus according to the first embodiment of the present invention. FIG. 4 is a sectional view taken along a line IV—IV of the planar acoustic converting apparatus shown in FIG. 3. FIG. 5 is a plan view schematically showing a structure obtained by omitting the diaphragm from the planar acoustic converting apparatus shown in FIG. 3.

Figure 4:
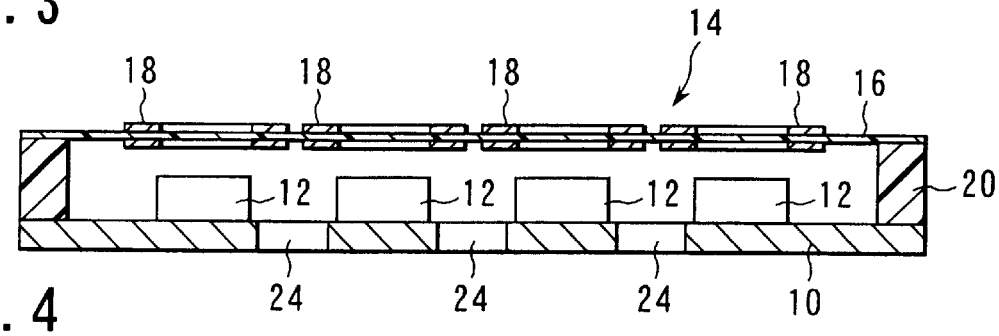
FIG. 4 is a sectional view taken along a line IV—IV of the planar acoustic converting apparatus shown in FIG. 3.
Figure 5:
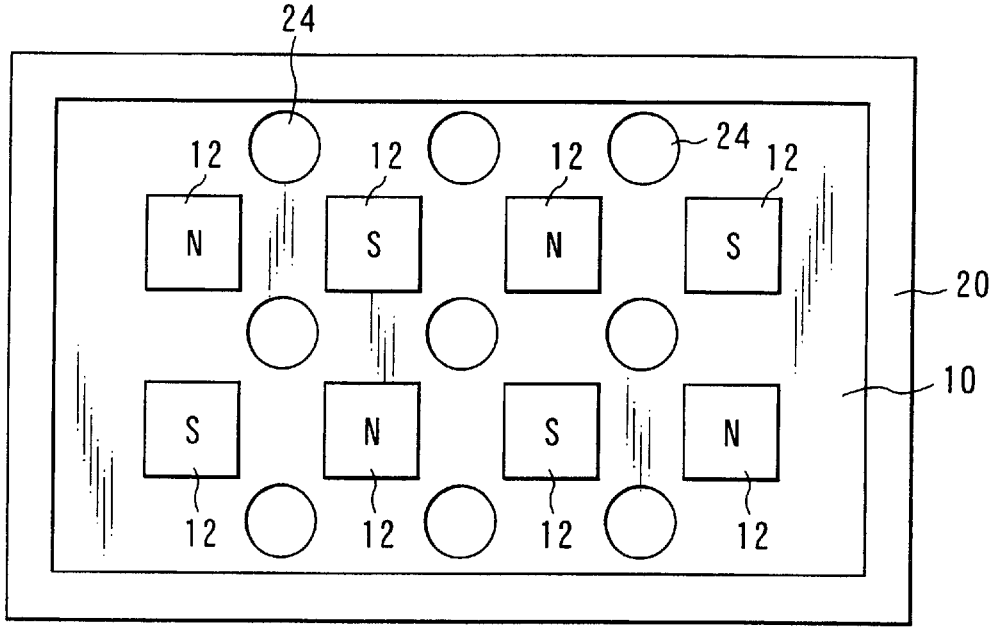
FIG. 5 is a plan view schematically showing a structure obtained by omitting the diaphragm from the planar acoustic converting apparatus shown in FIG. 3.

The planar acoustic converting apparatus shown in FIGS. 3 to 5 has a support 10. The structure of the support 10 is not particularly limited as long as it has a flat plate portion. As the support 10, for example, a flat-plate-shaped yoke formed from a ferromagnetic metal plate such as an iron plate can be used. The yoke 10 shown in FIGS. 3 to 5 has holes 22 for the input terminals of coils 18 and holes 24 serving as air vents.

Permanent magnets 12 are attached to one major surface of the yoke 10 such that their magnetic axes are perpendicular to the major surface of the yoke 10. The permanent magnets 12 are arrayed on one major surface of the yoke 10 while being spaced apart from each other by a predetermined gap, and attached to the yoke 10 such that adjacent permanent magnets have opposite polarities.

Figure 2:
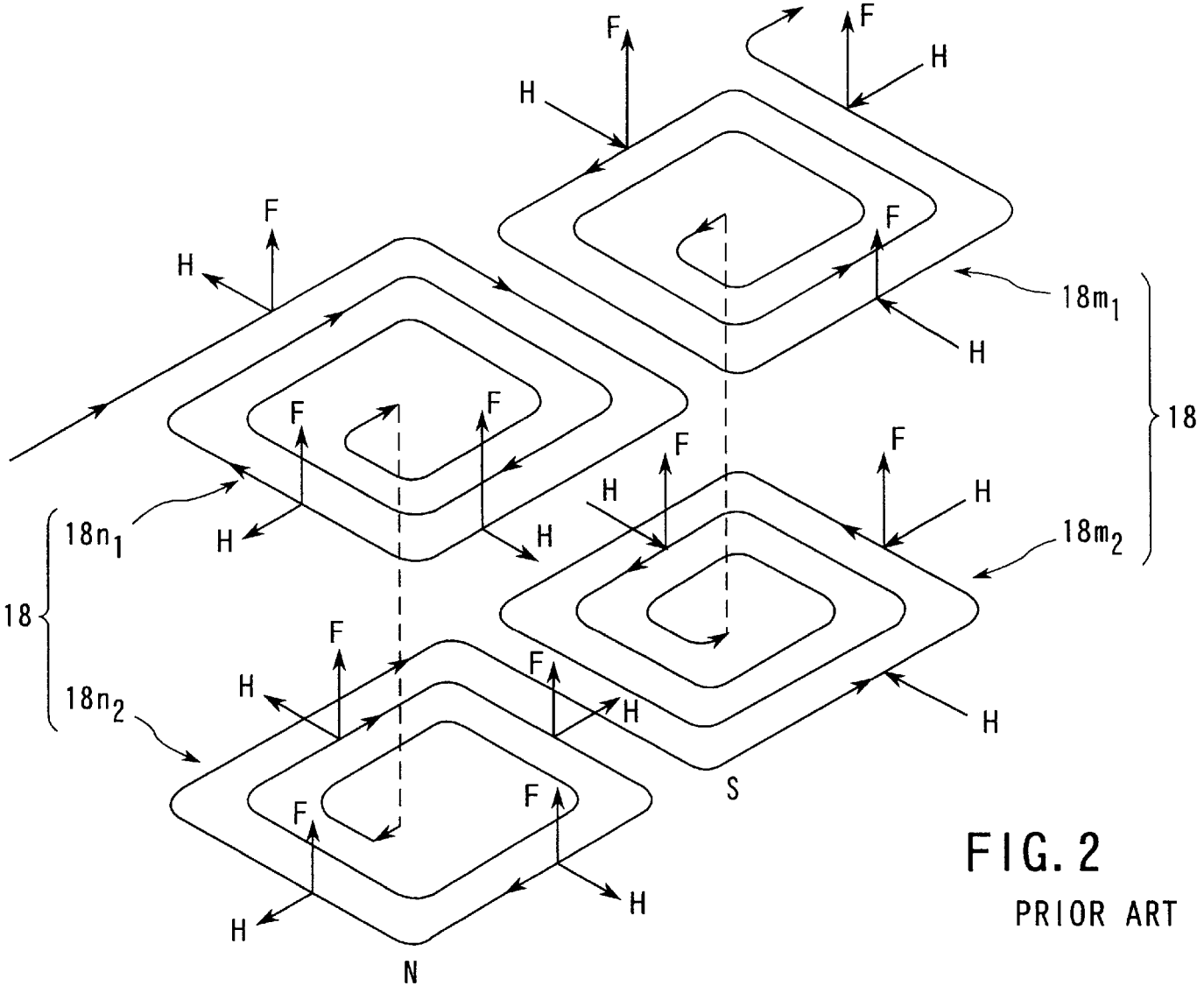
FIG. 2 PRIOR ART
FIG. 2 is a view schematically showing the wiring pattern of the spiral coils of the planar acoustic converting apparatus shown in FIG. 1.

The planar acoustic converting apparatus shown in FIGS. 3 and 4 also has a diaphragm 14. This diaphragm 14 has a structure in which spiral coils 18 are formed on both surfaces (or one surface) of an insulating base film 16 in correspondence with the permanent magnets 12. Each spiral coil 18 is made of a conductor such as copper and formed such that each of them surrounds a region being opposed to the magnetic pole of a corresponding permanent magnet 12 and such that, near the boundary between each two of the coils 18 adjacent to each other, a direction of current-flow through the conductor of one coil 18 is the same as that of another coil 18. That is, the coils 18 have the same structure as that shown in FIG. 2.

The diaphragm 14 is supported at its peripheral portion by a holding portion 20 and attached to the yoke 10 through the holding portion 20. The structure of the holding portion 20 is not particularly limited as far as it can hold the diaphragm 14 apart from the pole-faces of the permanent magnets 12 by a predetermined distance. For example, where the yoke 10 has an appropriate shape, the holding portion 20 may be part of the yoke 10. Alternatively, the holding portion 20 may be a frame-shaped spacer as shown in FIGS. 4 and 5. The spacer 20 is preferably made of an elastic material such as chloroprene foam.

In the planar acoustic converting apparatus according to this embodiment, the base film 16 is constituted by a liquid crystalline polymer film. A liquid crystalline polymer film has high heat resistance and mechanical strength and a small linear expansion coefficient. For example, for a certain liquid crystalline polymer film, a linear expansion coefficient of 15 to 20 ppm/° C. is obtained by measurements using a thermomechanical analyzer within the temperature range from 30° C. to 150° C. For this reason, in the planar acoustic converting apparatus according to this embodiment, even when the temperature of the base film 16 increases due to heat from the coils 18, the dimensions of the diaphragm 14 do not largely change.

In addition, the hygroscopicity of a liquid crystalline polymer film is much lower than that of a normal resin film. For example, when a polyimide film is left to stand in an atmosphere at 23° C. for 24 hrs, the moisture-absorption expansion coefficient is 2.9%, though a liquid crystalline polymer film exhibits a moisture-absorption expansion coefficient of 0.04% under the same conditions. For this reason, in the planar acoustic converting apparatus according to this embodiment, the base film 16 hardly expands even under a high humidity. For example, the moisture-absorption dimensional change rate of the above liquid crystalline polymer is 4 ppm/% RH at 60° C. That is, in the planar acoustic converting apparatus according to this embodiment, even in use for a long time or even under a high humidity, the diaphragm 14 hardly slacks, and therefore, the sound quality hardly degrades.

Generally, a liquid crystalline polymer film tends to have high tan δ. For example, tans of a certain liquid crystalline polymer film is 0.06 that is much higher than that (0.02) of a polyimide film. For this reason, in the planar acoustic converting apparatus according to this embodiment, generation of noise can be suppressed.

Furthermore, as described above, the linear expansion coefficient of a liquid crystalline polymer film is small. For this reason, in the planar acoustic converting apparatus according to this embodiment, the linear expansion coefficient difference between the base film 16 and the conductor such as copper that forms the coils 18 is small, and therefore, the coils 18 can be suppressed from peeling off from the base film 16. That is, high reliability can be realized.

The liquid crystalline polymer used for the base film 16 of this planar acoustic converting apparatus is not particularly limited as long as it constitutes a base film 16 without being melted under normal use conditions. A wholly aromatic polyester-based liquid crystalline polymer, for example main-chain-type copolymerized polyester containing para-hydroxy benzoic acid (PHB) as a main component, is preferably used. Especially, a copolyester-type material containing PHB and 6-oxy-2-naphthoic acid, such as VECTRA (trade name) available from Hoechst Celanese or Polyplastics, is preferably used. The chemical formula of VECTRA is shown below.

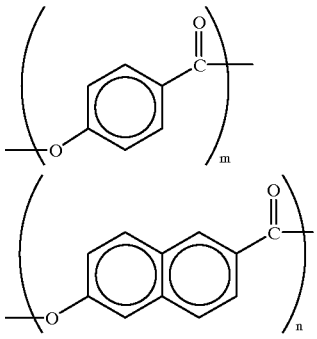

The base film 16 of this planar acoustic converting apparatus is preferably formed by inflation-molding the liquid crystalline polymer to align the molecules isotropically with respect to the planar direction. More specifically, first, a cylindrical film is formed by extruding a melted liquid crystalline polymer into a cylindrical shape. Then, a gas is supplied to its internal space to inflate the film by an internal pressure while cooing the film. After that, the film is opened along the extruding direction to form a flat film. The base film 16 can be obtained by cutting the flat film.

To form the spiral coils 18 on the liquid crystalline polymer film, a subtractive method (method of patterning a copper foil of a copper-clad laminate by etching to form a wiring pattern) can be employed, as in the prior art. Since the diaphragm 14 is desirable to be lightweight, the presence of an adhesive between the coils 18 and the base film 16 is not preferable. For this reason, in order to bond the copper foil to the liquid crystalline polymer film, heat fusion is preferably used. When a planar acoustic converting apparatus is formed using the diaphragm 14 obtained by thermally fusing a copper foil to a film of a polyester resin or the like, the coils 18 peel off from the base film 16 at the time of use due to Joule heat (about 200° C.) from the coils 18 and the vibration because the linear expansion coefficient of the polyester resin is largely different from that of copper. However, when a liquid crystalline polymer film is used as the base film 16, such peel-off hardly occurs because the liquid crystalline polymer and copper have almost the same linear expansion coefficient.

To form the spiral coils 18 on the liquid crystalline polymer film, an additive method (method of forming a wiring pattern on a base film using electroless plating or both electroless plating and electroplating) can also be employed. In the subtractive method, the wiring pattern size stability is low due to the influence of side etching, and it is difficult to reduce the variation in impedance of the coils 18. To the contrary, in the additive method, since the wiring pattern size stability is high, the variation in impedance of the coils 18 can be suppressed small.

The second embodiment of the present invention will be described next with reference to FIGS. 6 to 8.

Figure 6:
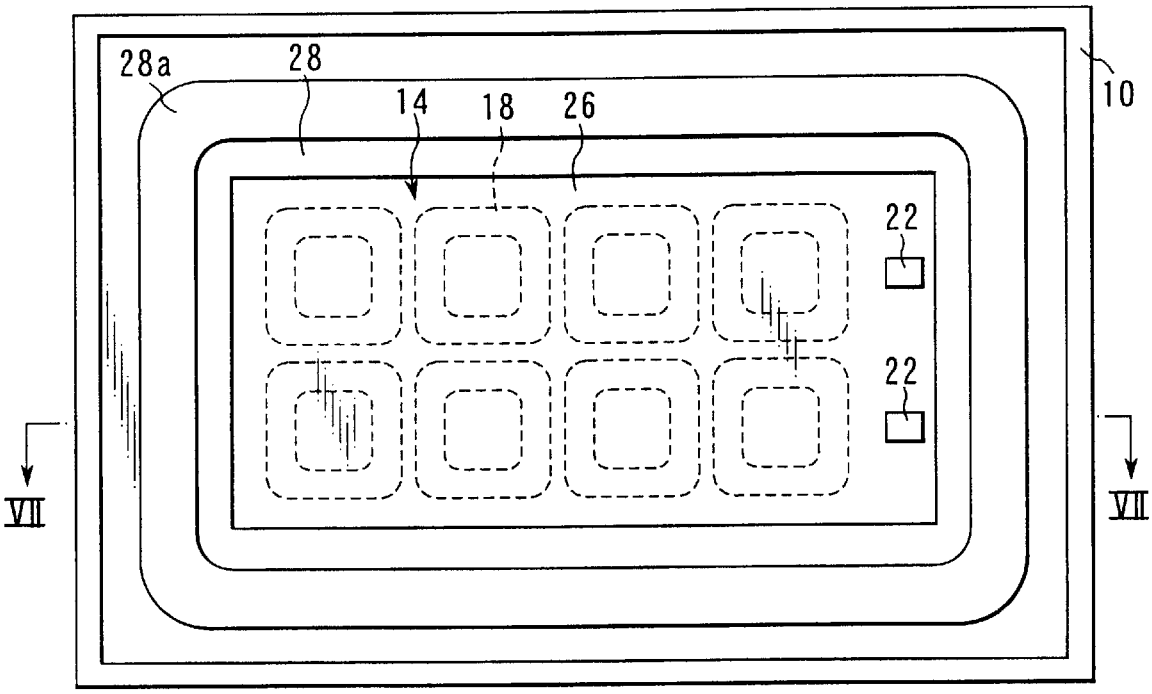
FIG. 6 is a plan view schematically showing a planar acoustic converting apparatus according to the second embodiment of the present invention.

FIG. 6 is a plan view schematically showing a planar acoustic converting apparatus according to the second embodiment of the present invention. FIG. 7 is a sectional view taken along a line VII—VII of the planar acoustic converting apparatus shown in FIG. 6. FIG. 8 is a partially enlarged sectional view showing a portion 40 of the planar acoustic converting apparatus shown in FIG. 7.

In the planar acoustic converting apparatus according to this embodiment, the flat plate portion of a yoke 10, and a side wall portion 10*a* and flange portion 10*b* at the periphery of the flat plate portion are integrated so that the yoke 10 has a shallow box shape.

A diaphragm 14 is supported at its peripheral portion by a frame-shaped elastic holding member (holding portion) 28. The inner peripheral portion of the holding member 28 is adhesively fixed to the peripheral portion of the diaphragm 14, and the outer peripheral portion of the holding member 28 is adhesively fixed to the flange portion 10*b* of the yoke 10. A wavy portion 28*a* is formed between the inner and outer peripheral portions of the holding member 28, thereby increasing the elasticity of the holding member 28. When the diaphragm 14 is held by such a holding member 28, an echo from the edge portion due to vibration of the diaphragm 14 is reduced, and the sound quality can be improved.

In this embodiment, insulation films 26 are formed on both surfaces of the diaphragm 14 so as to cover a base film 16 (liquid crystalline polymer film) and spiral coils 18. The insulation films 26 press the spiral coils 18 against the base film 16, thereby preventing the spiral coils 18 from peeling off from the base film 16 due to vibration.

The insulation films 26 are preferably formed using a paint containing an insulating resin which has high heat resistance and readily adheres to the liquid crystalline polymer film. An example of such a paint is an alkyd resin-based paint such as a paint that is based on an alkyd resin (an ester of a polybasic acid such as phthalic acid and a polyhydric alcohol such as glycerin) and denatured with oil or fatty acid.

A damper sheet 30 is bonded to pole-faces, which are on the side opposite to the side of the yoke 10, of permanent magnets 12. A gap G is formed between the damper sheet 30 and the diaphragm 14. With this structure, since the gap G is present, vibration of the diaphragm 14 is not hindered. In addition, since the damper sheet 30 is provided on the permanent magnets 12, contact noise can be suppressed even when the diaphragm 14 largely vibrates and comes into contact with the permanent magnets 12. For this reason, the sound quality can be improved, and noise can be suppressed. As the damper sheet 30, a non-woven fabric, Japanese paper, etc. can be used.

Each input terminal 22 of the diaphragm 14 is electrically connected, via a flexible conductor 36, to an external terminal 34 which is attached to the outer surface of the yoke 10 with an insulating plate 32 interposed therebetween. More specifically, as shown in FIG. 8, a through hole 16*a* is formed in the base film 16 in correspondence with the input terminal 22 of the diaphragm 14, and patterns 22*b* and 22*c* on the upper and lower surfaces are connected by through hole plating 22*d*. This prevents the input terminal 22 from peeling off from the base film 16. The flexible conductor 36 extends through the through hole 16*a* and is fixed by a solder 23.

Examples of the present invention will be described below.

EXAMPLE 1

Figure 7:
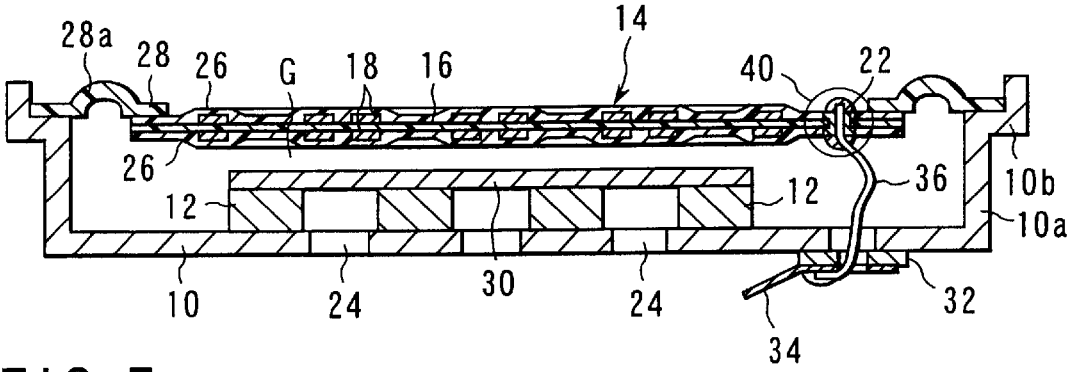
FIG. 7 is a sectional view taken along a line VII—VII of the planar acoustic converting apparatus shown in FIG. 6.
Figure 8:
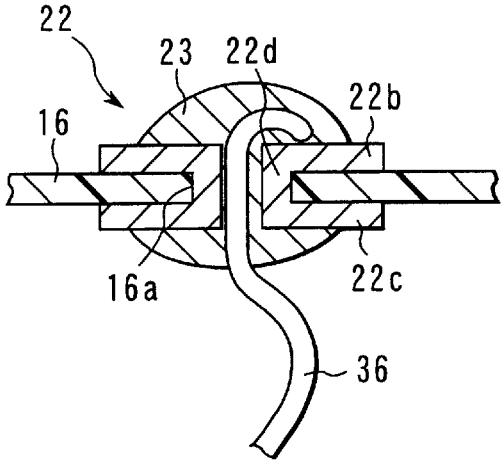
FIG. 8 is a partially enlarged sectional view showing a portion of the planar acoustic converting apparatus shown in FIG. 7.

Planar acoustic converting apparatus each having a width of 40 mm, a length of 140 mm, and a thickness of 7 mm were manufactured using the same structure as that shown in FIGS. 3 to 5 except that a diaphragm 14 shown in FIG. 7 was used. Three types of planar acoustic converting apparatus were manufactured using KURARAY CT which is a liquid crystalline polymer film and available from Kuraray, a polyimide film, and a PET film as a base film 16 of the diaphragm. In each planar acoustic converting apparatus, 24 neodymium magnets 12 each having a 9×9 mm square pole-faces and a thickness of 3 mm were arrayed in a 2×12 matrix on a flat-plate-shaped yoke 10 having holes 24 such that adjacent magnets had opposite polarities, as shown in FIG. 5.

The wiring pattern of the diaphragm 14 was formed by the additive method. First, a wet-blast process was performed for the base film 16 as roughening process. Next, the base film 16 was perforated at positions (through hole portions) where coils 18 on its both surfaces were to be electrically connected and positions (terminal portions) corresponding to input terminals of the coils 18. The perforations of the base film 16 at the terminal positions were performed in order to connect the terminals on both surfaces and increase the peeling strength at the terminal portions. After that, electroless copper plating, plating resist printing, copper electroplating, plating resist removal, etching, and insulation film formation by coating were executed, thereby completing the diaphragm 14 having, on both surfaces, 24 spiral coils 18 and insulation films 26 that covered the coils 18 and base film 16.

The impedance between the terminals was set to 6 Ω. In Example 1, a 5-mm thick chloroprene foam member was used as a spacer 20. The spacer 20 was adhesively fixed to the outer peripheral portion of the flat-plate-shaped yoke 10, as shown in FIG. 4. The diaphragm 14 was adhesively fixed on the spacer 20. With this structure, the distance between the diaphragm 14 and the permanent magnets 12 was kept constant.

Figure 9:
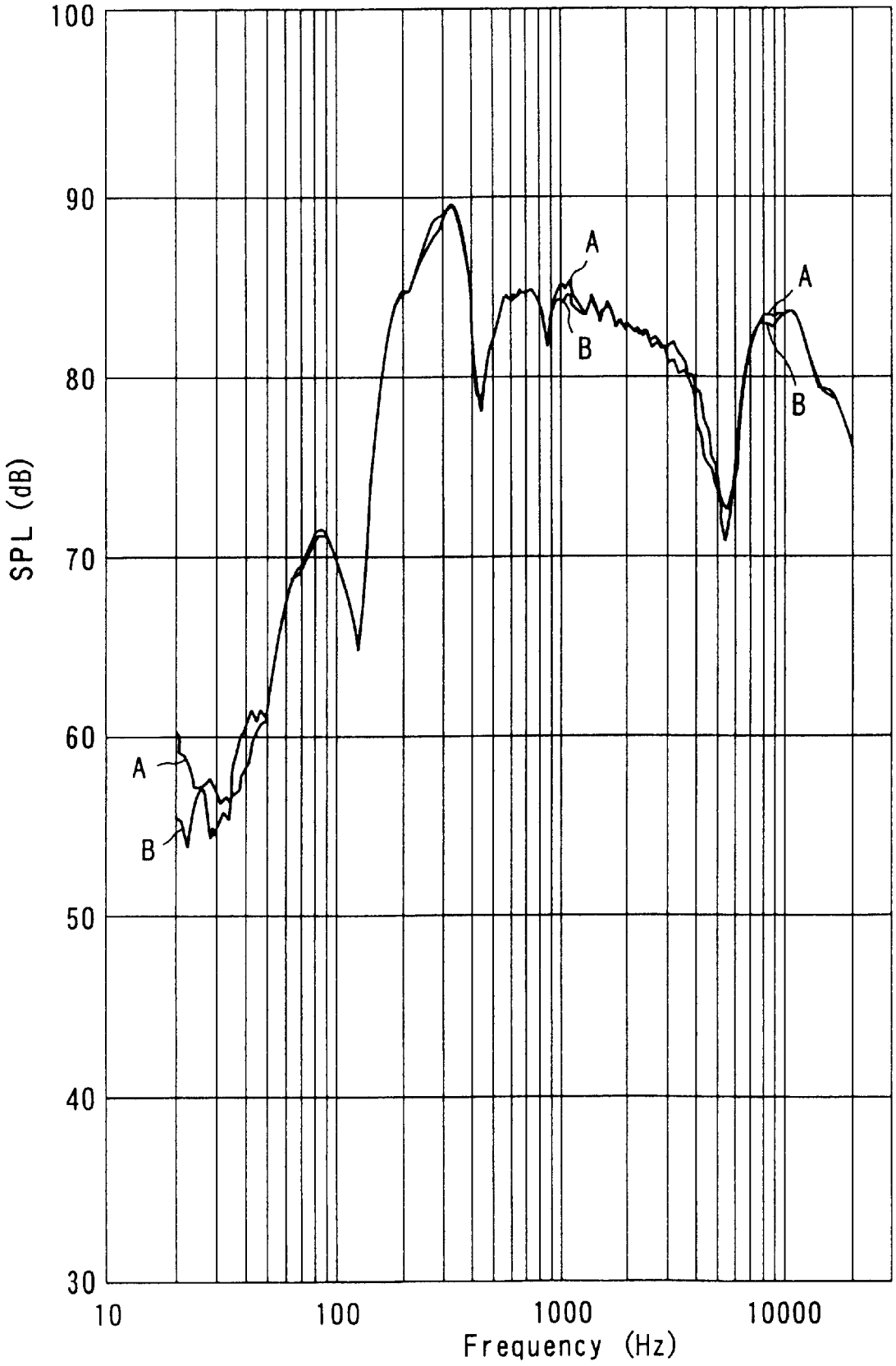
FIG. 9 is a graph showing a sound pressure level (SPL) characteristic obtained for a planar acoustic converting apparatus according to Example 1 of the present invention, which used a liquid crystalline polymer film as a base film, before and after temperature and temperature/humidity cycle tests.
Figure 10:
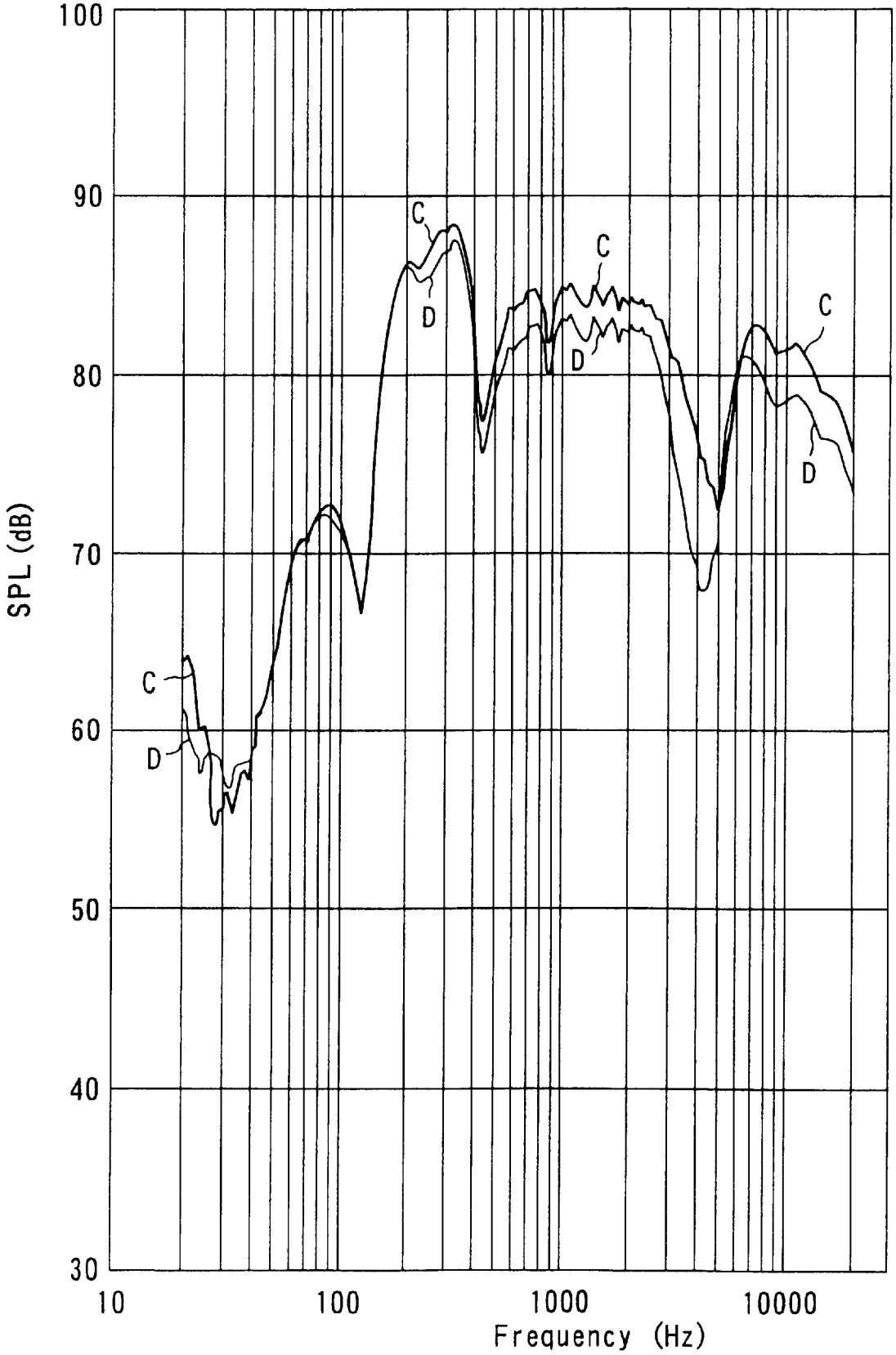
FIG. 10 is a graph showing a SPL characteristic obtained for a planar acoustic converting apparatus according to Example 1 of the present invention, which used a polyimide film as a base film, before and after temperature and temperature/humidity cycle tests.

For each of the resultant planar acoustic converting apparatus, the SPL vs. frequency characteristic was measured by applying a sinusoidal signal of 300 mV within the range of 20 Hz to 20 kHz. Additionally, for each of the planar acoustic converting apparatus, a temperature cycle test and temperature/humidity cycle test were executed and after that, the SPL vs. frequency characteristic was measured again. The temperature cycle test and temperature/humidity cycle test were executed in accordance with conditions of automobile standards [JASO(DO01–94)] while applying white noise of 10 W. FIGS. 9 and 10 show the obtained results.

FIG. 9 is a graph showing the test results obtained for the planar acoustic converting apparatus that used a liquid crystalline polymer film as the base film 16. Referring to FIG. 9, reference numeral A denotes a SPL characteristic before the temperature cycle test and temperature/humidity cycle test, and reference numeral B denotes a SPL characteristic after the tests. As is apparent from comparison between the curves A and B in FIG. 9, the two characteristics almost overlap each other. In the planar acoustic converting apparatus that used a liquid crystalline polymer film as the base film 16, the SPL characteristic changed little before and after the tests.

FIG. 10 is a graph showing the test results obtained for the planar acoustic converting apparatus that used a polyimide film as the base film 16. Referring to FIG. 10, reference numeral C denotes a SPL characteristic before the temperature cycle test and temperature/humidity cycle test, and reference numeral D denotes a SPL characteristic after the tests. In the planar acoustic converting apparatus that used a polyimide film as the base film 16, the SPL characteristic changed before and after the tests, and the SPL was reduced after the tests. The same result as described above was obtained for the planar acoustic converting apparatus using a PET film.

If no insulation films 26 were provided, in the planar acoustic converting apparatus that used a polyimide film or PET film as the base film 16, the coils 18 peeled off from the base film 16 after use for a long time. However, in the planar acoustic converting apparatus that used a liquid crystalline polymer film as the base film 16, such peel-off hardly took place even without the insulation films 26. When the insulation films 26 were provided, peel-off could be almost completely prevented.

EXAMPLE 2

Planar acoustic converting apparatus were manufactured using the same structure as that described in Example 1 except that a diaphragm 14 formed by the following method was used. In Example 2, the same three types of base film 16 as in Example 1 were used, a 18-μm thick copper foil was stacked on each surface of each base film 16 to form spiral coils 18 by the subtractive method. Each through hole portion was filled with copper plating to electrically connect the spiral coils 18 on both surfaces with each other. The impedance was set at 6 Ω. as in Example 1. Planar acoustic converting apparatus each having the same dimensions as in Example 1 were manufactured using the diaphragms thus obtained.

For each resultant planar acoustic converting apparatus, the SPL characteristic was measured by the same way as in Example 1. As a consequence, almost the same characteristics as in Example 1 were obtained. That is, no difference in SPL characteristic was observed due to the difference in method of manufacturing the diaphragm 14. In the subtractive method, however, since the size stability of the spiral coils is lower than that in the additive method, the variation of the impedance was easy to occur, and it was difficult to accurately set the impedance at 6 Ω.

EXAMPLE 3

Figure 11:
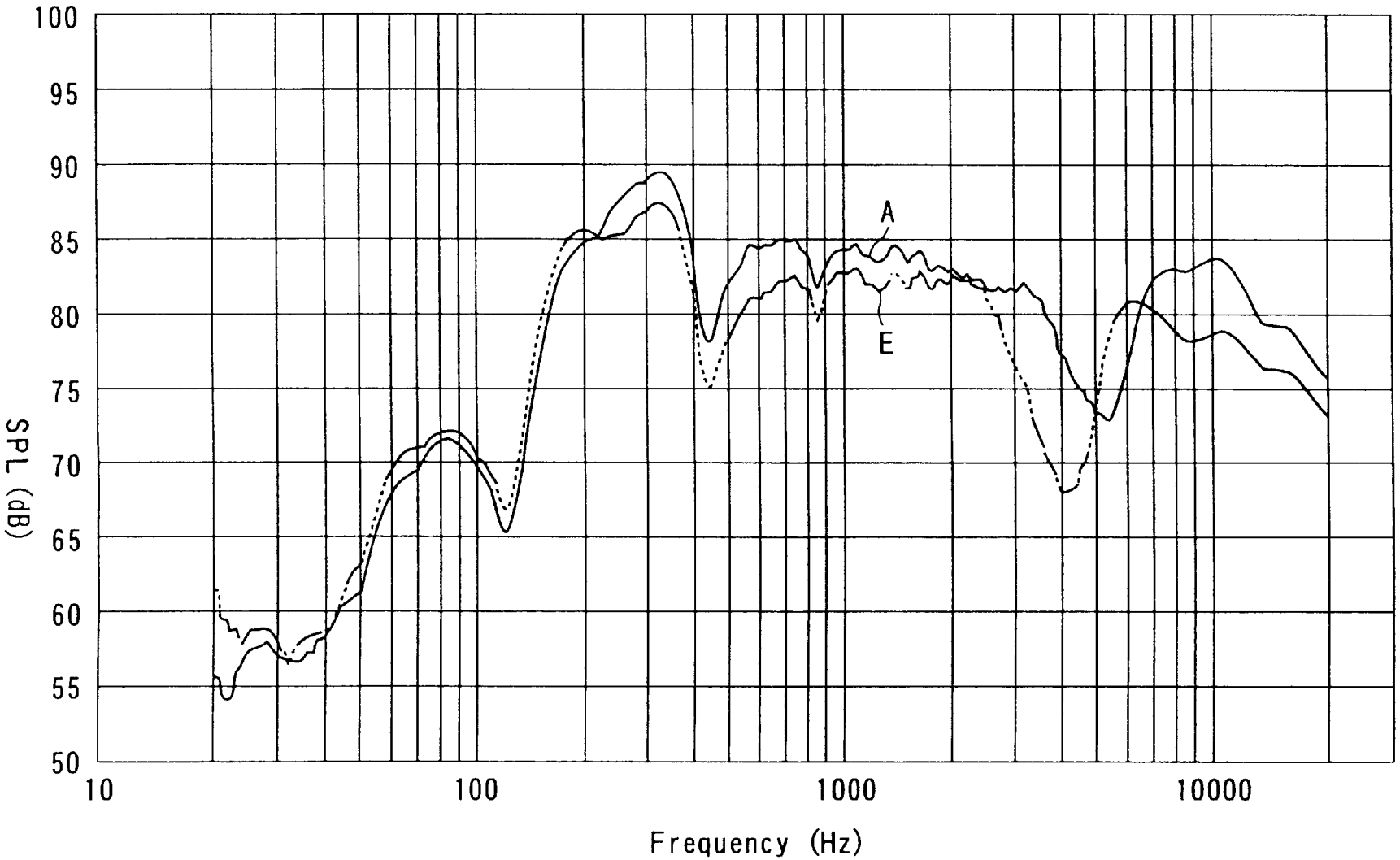
FIG. 11 is a graph showing a SPL characteristic obtained for a planar acoustic converting apparatus according to Example 3 of the present invention.

A planar acoustic converting apparatus was manufactured using a 50-μm thick liquid crystalline polymer film (KURARAY CT available from Kuraray) as a base film 16 of a diaphragm 14 according to the same procedure as described in Example 2. Another planar acoustic converting apparatus was manufactured according to the same procedure as in Example 2 except that an aramid non-woven fabric reinforced crosslinked polyester sheet (TOYOBO COSMOFLEX available from Toyobo) was used as the base film 16 of the diaphragm 14. For each of these planar acoustic converting apparatus, the SPL characteristic was measured. FIG. 11 shows the results.

Referring to FIG. 11, a curve A represents the SPL characteristic obtained for the planar acoustic converting apparatus using the liquid crystalline polymer film as the base film 16. A curve E represents the SPL characteristic obtained for the planar acoustic converting apparatus using the aramid non-woven fabric reinforced crosslinked polyester sheet as the base film 16. As is apparent from comparison between the curves A and E, the planar acoustic converting apparatus using the liquid crystalline polymer film was more excellent in SPL characteristic in the high-frequency region as compared to the planar acoustic converting apparatus using the aramid non-woven fabric reinforced crosslinked polyester sheet.

As has been described above, according to the present invention, generation of noise from planar acoustic converting apparatus can be supressed. In addition, when a liquid crystalline polymer film is used as the base film of the diaphragm, the diaphragm hardly slacks even under a high humidity environment, and therefore, degradation in sound quality can be suppressed. Also, when a damper sheet is bonded to the pole-faces, which are on the side opposite to the side of the yoke, of the permanent magnets, and a gap is formed between the damper sheet and the diaphragm, impact noise between the diaphragm and the permanent magnets can be suppressed without hindering free vibration of the diaphragm. Furthermore, when an insulation film is provided on each surface of the diaphragm so as to cover the base film and spiral coils, the spiral coils can be suppressed from peeling off from the base film.

To be more specific, the present invention provides a planar acoustic converting apparatus in which slack of the diaphragm hardly occur and degradation in sound quality is suppressed. Also, the present invention provides a planar acoustic converting apparatus in which impact noise between the diaphragm and the permanent magnets is suppressed and free vibration of the diaphragm is not hindered. Further, the present invention provides a reliable planar acoustic converting apparatus in which the spiral coils of the diaphragm hardly peel off from the base film.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A planar acoustic converting apparatus comprising:

a support having a flat plate portion;

a diaphragm comprising an insulating base film having a liquid crystalline polymer film and being opposed to the flat plate portion of said support, and at least one spiral coil provided on one major surface or both major surfaces of the insulating base film;

at least one permanent magnet supported by said support and opposing a magnetic pole thereof to said diaphragm; and a holding portion provided to said support and holding said diaphragm such that the diaphragm can vibrate and is positioned apart from said at least one permanent magnet.

2. The apparatus according to claim 1, further comprising a damper sheet provided on a surface of said at least one permanent magnet being opposed to said insulating base film.

3. The apparatus according to claim 2, wherein said diaphragm further comprises an insulation film which covers said at least one spiral coil and said insulating base film.

4. The apparatus according to claim 1, wherein said diaphragm further comprises an insulation film which covers said at least one spiral coil and said insulating base film.

5. The apparatus according to claim 1, wherein said liquid crystalline polymer film contains a wholly aromatic polyester-based liquid crystalline polymer.

6. The apparatus according to claim 5, wherein the liquid crystalline polymer contains a copolymer of para-hydroxy benzoic acid.

7. The apparatus according to claim 5, wherein the liquid crystalline polymer contains a copolymer of para-hydroxy benzoic acid and 6-oxy-2-naphthoic acid.

8. The apparatus according to claim 2, wherein said damper sheet comprises at least one of a non-woven fabric and Japanese paper.

9. The apparatus according to claim 4, wherein said insulation film is a coating film.

10. The apparatus according to claim 9, wherein said coating film is formed with use of a paint containing an alkyd resin.

11. The apparatus according to claim 1, wherein said at least one spiral coil consists essentially of copper.

12. A planar acoustic converting apparatus comprising:

a support having a flat plate portion;

a diaphragm comprising an insulating base film and being opposed to the flat plate portion of said support, and at least one spiral coil provided on one major surface or both major surfaces of the insulating base film;

at least one permanent magnet supported by said support and opposing a magnetic pole thereof to said diaphragm;

a damper sheet provided on a surface of said at least one permanent magnet being opposed to said insulating base film; and a holding portion provided to said support and holding said diaphragm such that the diaphragm can vibrate and is positioned apart from said at least one permanent magnet.

13. The apparatus according to claim 12, wherein said damper sheet comprises at least one of a non-woven fabric and Japanese paper.

14. The apparatus according to claim 12, wherein said diaphragm further comprises an insulation film which covers said at least one spiral coil and said insulating base film.

15. The apparatus according to claim 14, wherein said insulation film is a coating film.

16. The apparatus according to claim 15, wherein said coating film is formed with use of a paint containing an alkyd resin.

17. A planar acoustic converting apparatus comprising:

a support having a flat plate portion;

a diaphragm comprising an insulating base film having a liquid crystalline polymer film and being opposed to the flat plate portion of said support, at least one spiral coil provided on one major surface or both major surfaces of the insulating base film, and an insulation film which covers said at least one spiral coil and said insulating base film;

at least one permanent magnet supported by said support and opposing a magnetic pole thereof to said diaphragm; and a holding portion provided to said support and holding said diaphragm such that the diaphragm can vibrate and is positioned apart from said at least one permanent magnet.

18. The apparatus according to claim 17, wherein said insulation film is a coating film.

19. The apparatus according to claim 18, wherein said coating film is formed with use of a paint containing an alkyd resin.

* * * * *